United States Patent [19]

Uhlig et al.

[11] 4,392,579

[45] Jul. 12, 1983

[54] CLOSURE WITH DOMED PORTION

[75] Inventors: Albert R. Uhlig, Toledo; Long F. Chang, Sylvania, both of Ohio

[73] Assignee: Owens-Illinois, Inc., Toledo, Ohio

[21] Appl. No.: 313,394

[22] Filed: Oct. 21, 1981

[51] Int. Cl.[3] ..... B65D 51/16

[52] U.S. Cl. ..... 215/253; 215/260; 215/307; 215/DIG. 1

[58] Field of Search ..... 215/253, 260, 307, DIG. 1

[56] References Cited

U.S. PATENT DOCUMENTS

| | | | |
|---|---|---|---|
| 1,858,356 | 5/1932 | Brown | 215/DIG. 1 |
| 2,455,479 | 7/1949 | Hadley et al. | 215/42 |
| 2,866,570 | 12/1958 | Powell | 215/56 |
| 3,170,588 | 2/1965 | Lyon, Jr. | 220/60 |
| 3,455,500 | 7/1969 | Wilcox | 215/DIG. 1 |
| 3,589,545 | 6/1971 | Carpenter, Jr. et al. | 215/56 |
| 3,713,545 | 1/1973 | Lawrence et al. | 215/56 |
| 3,717,276 | 2/1973 | Luczak et al. | 215/40 |
| 3,923,185 | 12/1975 | Choksi et al. | 215/253 X |
| 3,933,265 | 1/1976 | Karlan | 215/260 |
| 4,007,857 | 2/1977 | Tomiati et al. | 222/153 |
| 4,016,996 | 4/1977 | Aichinger et al. | 215/260 X |
| 4,076,142 | 2/1978 | Naz | 215/307 |
| 4,089,463 | 5/1978 | Babiol | 215/344 X |
| 4,177,906 | 12/1979 | Von Hagel | 215/252 |
| 4,231,489 | 11/1980 | Malone | 215/307 X |

FOREIGN PATENT DOCUMENTS

| | | | |
|---|---|---|---|
| 1107541 | 5/1961 | Fed. Rep. of Germany | 215/DIG. 1 |
| 587755 | 5/1977 | Switzerland . | |
| 607702 | 10/1978 | Switzerland | 215/DIG. 1 |
| 932356 | 7/1963 | United Kingdom | 215/260 |
| 969322 | 9/1964 | United Kingdom | 215/260 |

*Primary Examiner*—Donald F. Norton

*Attorney, Agent, or Firm*—Thomas L. Farquer; M. E. Click; D. H. Wilson, Jr.

[57] ABSTRACT

A thermoplastic threaded closure for a fluid container comprises a relatively rigid, generally curvilinear dome, and an internally threaded annular skirt depending from the periphery thereof. An annular plug sealing member depends from the inside concave surface of the dome, and is constructed and arranged for a slight interference fit within an associated container finish. A plurality of circumferentially spaced venting ports may be provided through the dome, between the plug and the skirt.

6 Claims, 5 Drawing Figures

CLOSURE WITH DOMED PORTION

BACKGROUND OF THE INVENTION

1. Field of the Invention

The invention provides an improved molded thermoplastic closure, especially for containers of pressurized fluid, such as carbonated beverages.

2. Description of the Prior Art

The typical prior art thermoplastic closure comprises a flat disc-shaped panel and an annular skirt depending from the periphery thereof, threaded to engage corresponding threads on the container finish. A seal is formed by an annular plug depending from the flat panel, constructed and arranged to engage the inside annular surface of the finish by an interference fit. One example of such a prior art closure is shown in U.S. Pat. No. 4,016,996 to Aichinger et al.

A problem common to all threaded closures for pressurized fluid is the possibility of the premature release of the closure from the container finish during removal of the closure. As the closure is unthreaded, the seal is broken, and pressure within the head space is applied to the panel and the skirt of the closure, tending to deform the skirt and disengage the threads. If either the container threads or the closure threads are not properly formed, the closure can be prematurely stripped from the threads. While some prior art closures provide means for venting the head space as soon as the seal is broken by axial movement of the cap, the pressure must be vented while there is sufficient thread engagement to retain the closure. This problem tends to be greater in closures which have a plug inserted within the finish, because the closure must be unthreaded a significant distance before the plug is removed from the finish, thereby breaking the seal. The reduced thread engagement when the seal is first broken can increase the possibility of premature release.

Although careful thread design can alleviate the problem by permitting venting of head space through the threads, various other configurations of vents in the threaded finish and in the closure itself have been suggested. For example, U.S. Pat. No. 4,007,848 to Snyder discloses a container finish having one or more axial grooves through the threads. U.S. Pat. No. 4,007,851 to Walker discloses a metal closure having radial venting ports formed in the skirt.

A second problem with the typical thermoplastic closure is seal failure, especially in conditions of elevated temperatures and pressures. Any thermoplastic material will experience some degree of cold flow which will adversely affect seal performance. Therefore, closures are designed to be "self sealing," that is, increased internal pressure is utilized to enhance sealing performance.

A thermoplastic closure including an annular plug seal is designed to be self sealing in this manner. Ideally, increased internal pressure acting on the inside annular surface of the plug increases the outward force of the plug against the inside annular surface of the finish, thereby enhancing seal performance. In practice, however, this effect is very minimal, in part because of the short axial extent of the plug, which is therefore rather rigid. In the typical closure design, the axial extent of the plug is limited by the requirement that the head space be vented early in the removal operation, while there remains sufficient thread engagement to retain the closure.

Because the self sealing effect in the typical annular plug closure is minimal, such closures rely primarily on the initial interference fit between the plug and the finish to effect a seal. The relatively large interference thus required undesirably increases the closure removal torque requirement. Another approach is to provide the lower edge of the plug seal with a deformable lip or skirt to improve the seal, such as is shown in U.S. Pat. No. 4,090,631 to Grussen. This approach requires a more complex mold design and makes resealing difficult.

Finally, a major problem in the prior art is the loss of the seal caused by distortion of the closure due to internal pressure. In the common flat paneled closure, high internal pressures will tend to cause the panel to bulge outwardly. This distortion of the panel moves the plug upwardly along the container finish, thereby moving the location of the seal. It is known that such a dynamic seal is significantly more subject to failure than a static seal and that such distortion necessarily requires the plug seal to extend axially well into the bottle finish, thus increasing venting problems when the cap is removed as discussed above.

SUMMARY OF THE INVENTION

This invention provides an improved molded thermoplastic closure having a curvilinear upper dome, a threaded annular skirt depending from the periphery of the dome, and an annular plug depending from the inside surface of the dome. At least the annular portion of the dome adjacent the skirt comprises a convex curvilinear segment. The extreme upper surface of the dome may continue the hemispherical shape, or may be flat, to facilitate the imprinting of suitable indicia. Compared with a flat closure panel, the relatively stronger domed configuration of the invention prevents any significant bulging which would tend to lift the annular plug from engagement with the inside surface of the finish, thus maintaining the static nature of the plug seal.

The plug is integrally formed with the dome and projects downwardly from its inside concave spherical surface. When the closure is applied to a container, the container rim abuts the concave spherical segment surface between the annular plug and the annular skirt. This contact provides a locating abutment for the closure and the plug. While a prior art cap design as shown in Swiss Patentschrift No. 607,702 appears to include a curvilinear shoulder between the annular skirt and a flat top, the annular plug in that construction extends from the inner surface of the flat top and the curvilinear surface is not exposed to fluid pressure so that the Swiss construction does not have the advantages of this invention.

A plurality of circumferentially spaced venting ports are formed through the dome surface, between the plug and the skirt, radially positioned between the plug-finish seal and the annular area where the container rim abuts the inner concave surface of the dome.

The closure configuration thus far described offers several advantages. The dome extends upwardly from the annular line of contact with the rim. Therefore, the juncture between the dome and plug is axially further from the rim than is the case with the standard flat panel closure. Hence, the plug may be made longer without extending excessively into the finish. The longer plug provides a greater area for internal pressures to act against, thereby enhancing the self-sealing performance of the closure. Therefore, only a slight initial interference fit between the plug and the finish is necessary, allowing for reduction in the removal torque requirement.

In addition, the configuration of the dome resists deformation from internal pressures, as described above, and has an outward unique and pleasing appearance. Finally, the curvature of the dome provides a convenient space for the plurality of spaced-apart vents through the dome which, as will be seen below, give the closure of this invention certain advantages over those known in the prior art and can provide, in one embodiment, a pilfer indicator which will indicate if the closure has been prematurely removed.

Other objects and advantages of this invention will be apparent to those skilled in the art from the following description of the preferred embodiments thereof, with reference made to the accompanying drawings.

DESCRIPTION OF THE PREFERRED EMBODIMENTS

Figure 1:
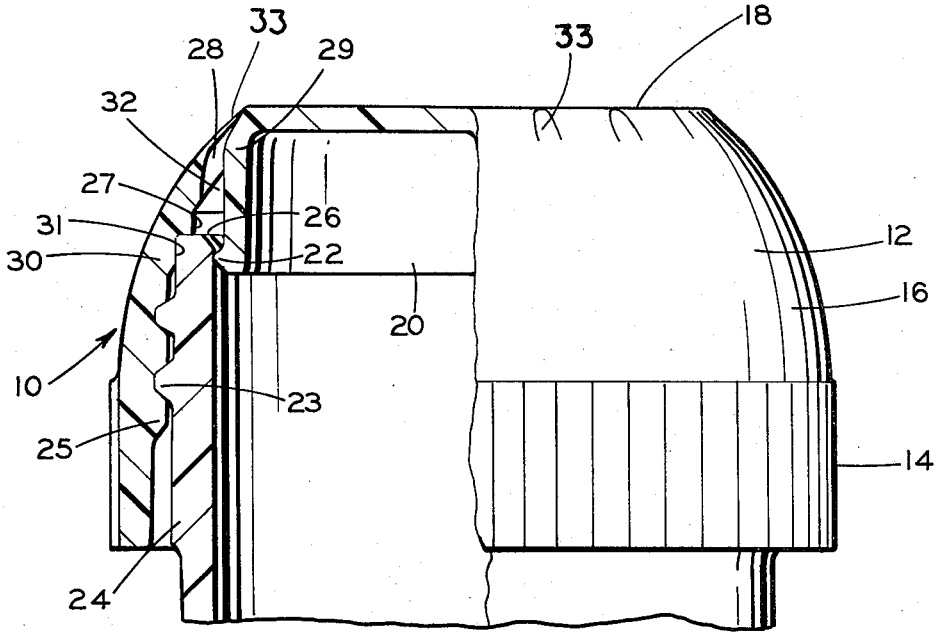
FIG. 1 is an elevational view, in half section, of a closure embodying the present invention, in sealing relationship with a conventional container finish.

As illustrated in the drawings, a closure 10 embodying the present invention comprises a dome 12 and an annular skirt 14 depending from the periphery thereof. The annular portion of the dome 12 adjacent the skirt 14 comprises a generally spherical or elliptical segment 16 having a convex outside surface, and a concave inside surface. The extreme upper surface 18 of the dome 12 may comprise a continuation of the curvilinear segment 16, or, as illustrated, may comprise a flat panel 18 suitable for the imprinting of indicia.

An annular plug 20 is integrally formed with the dome 12 and depends from the inside surface of the spherical segment 16. The bottom portion of the plug 20 comprises a relatively thick, outwardly projecting sealing bead 22 sized for a slight interference fit within the inside cylindrical surface of an associated container finish portion 24.

The skirt 14 is provided with internal threads 25, which are engagable with complementary threads 23 formed on the container finish 24. As the closure 10 is rotationally applied to its final position on the container finish 24, the annular rim 26 of the finish 24 contacts an annular abutment 27 integrally formed on the inside concave surface of the spherical segment 16 between the skirt 14 and the plug 20. The abutment 27 provides a positive axial closure stop and provides for the accurate axial location of the plug 20 within the container finish 24.

The curvilinear segment 16 extends upwardly from the abutment 27 to the root 29 of the plug 20 on the inside surface of the dome 12. Therefore, as compared with conventional closures having flat panels, the plug 20 is longer without extending an excessive distance into the container finish 24. The increased axial length of the plug 20 provides an increased inside annular surface area of the plug 20, against which internal pressures act to provide a self sealing effect. The minimal extension of the plug 20 into the finish 24 assures that the venting of the primary seal therebetween will occur early during the removal process, thereby minimizing the possibility of premature closure release.

An integrally formed secondary sealing member 30 projects radially inwardly from the inside surface of the dome 12 above the closure threads 25. The secondary sealing member 30 includes a cylindrical surface 31 constructed and arranged to engage the outer annular surface of the finish 24 with a slight interference fit.

Figure 2:
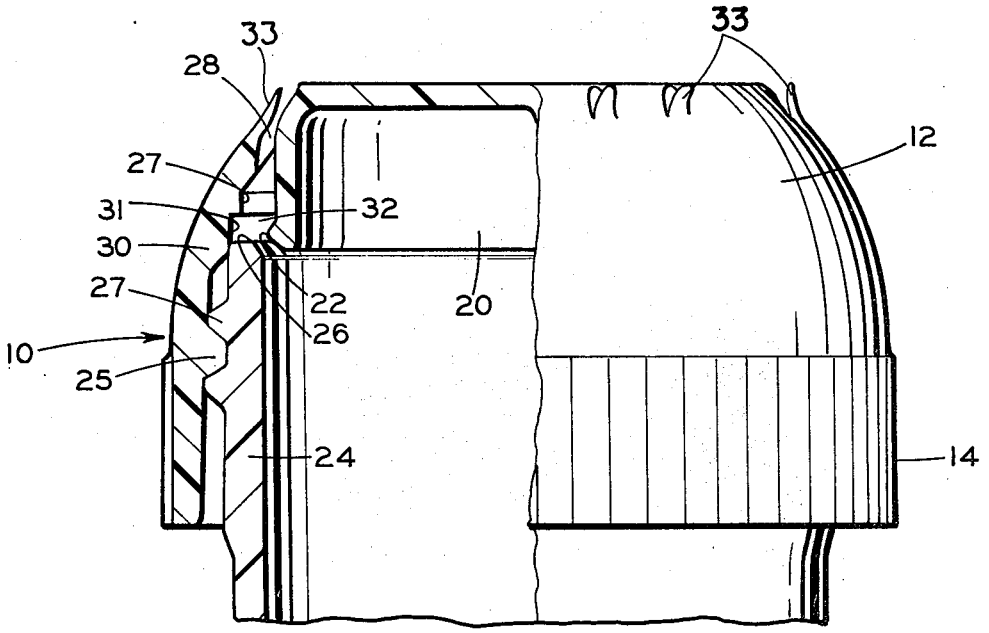
FIG. 2 is an elevational view, in half section, of the closure illustrated in FIG. 1, as the seal is first broken during rotational removal of the closure.

In the embodiment illustrated in FIGS. 1 and 2, venting is provided by a plurality of circumferentially spaced ports 28 formed through the curvilinear segment of the dome 16, between the abutment 27 and the root 29 of the plug 20. As illustrated, an annular chamber 32 is provided between the abutment 27 and the plug 20. During removal of the closure 10, as soon as the seal between the plug 20 and the finish 24 is broken, pressure will be vented from the head space immediately to the annular chamber 32 and thence outwardly through the ports 28. The ports 28 provide a direct, short path for venting of the chamber 32, which is less restrictive than conventional venting paths defined by axially slotted finishes extending downwardly across the threads.

As illustrated in FIG. 2, when the seal between the plug 20 and the finish 24 is first broken, the annular secondary sealing member 30 remains in contact with the outer annular surface of the finish 24. Hence, the sealing member 30 prevents fluid communication between the chamber 32 and the annular space between the skirt 14 and the outer annular threaded surface of the finish 24. Therefore, the pressurized fluid escaping from the head space to the chamber 32 does not tend to expand the skirt 14 to cause the closure 10 to be prematurely stripped from the finish 24, a problem encountered in some prior art designs.

Some fluid will accumulate in the chamber 32 during the venting process, but will drain back into the container as the closure 10 is being removed. Accumulation and drainage from the chamber 32 minimize excessive loss of contents during venting, an advantage also not found in some prior art designs.

As seen in FIGS. 1 and 2, the venting ports 28 are preferably angled upwardly and inwardly to divert the vented pressure fluid towards a focal point axially above the center of the dome 12. Thus the pressure is directed upwardly and away from the consumer who is opening the closure, and not downwardly through the threads, as the case with certain prior art closures, wetting the hand and bottle.

In a preferred embodiment of this invention, the venting ports 28 are sealed by thin frangible membranes 33 integrally molded as part of the upper convex surface of the dome 12. The membranes 33 prevent external contaminates from entering the ports 28 and the chamber 32 during storage of the container. However, the membranes are thin enough to readily burst when exposed to internal fluid pressure as the container seal is broken during initial removal rotation of the closure 10. Thus the condition of the membranes 33 provide a visual tamper indicator, eliminating the need for a conventional annular tamperproof band depending from the closure skirt 14 as is often provided by prior art closures.

The advantages of a pressure resistant dome shape can be achieved by several different specific shapes. In the embodiment of FIGS. 1 and 2, the dome 12 has a spherical surface with a radius approximately equal to the radius of the skirt 14. The lower portion of the spherical segment 16 of the dome 12 blends smoothly into the skirt 14. The upper portion of the dome terminates in the flat panel portion 18. In other embodiments, the dome may have various different shapes. All have in common a generally domed shape which is convex outwardly, and curves upwardly and inwardly from the top of the skirt 14.

Figure 3:
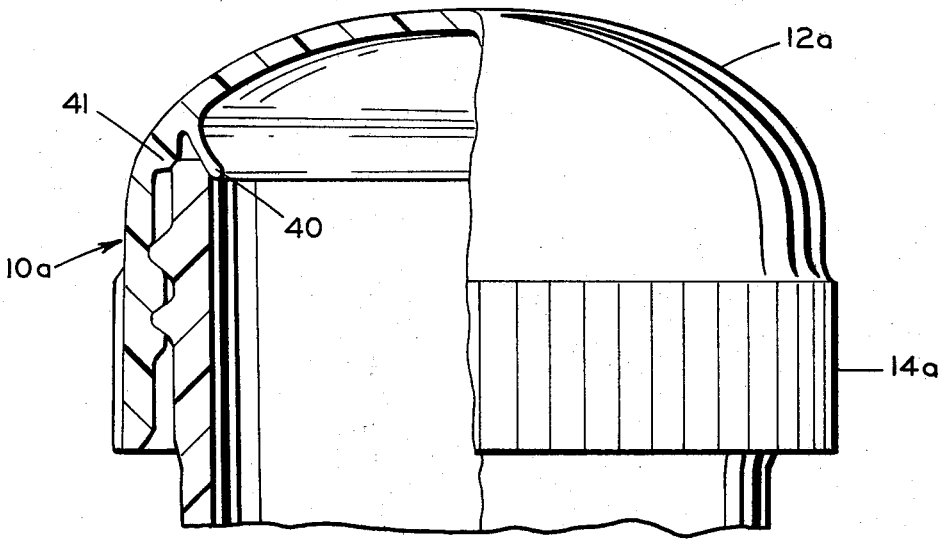
FIG. 3 is a sectional view of an alternative embodiment of a closure according to the invention having a dome defining an ellipsoidal surface.

As illustrated in FIG. 3, a closure 10*a* embodying an alternative of the invention includes a dome 12*a* having an oblate ellipsoidal surface. The vertical cross-section of the dome 12*a* is elliptical, with its major axis parallel with the radius of the skirt 14*a*. The ellipsoidal surface of the dome 12*a* blends smoothly into the cylindrical surface of the skirt 14*a* and the geometrical configuration provides the same advantages as those of a spherical surface as shown in FIGS. 1 and 2.

Figure 5:
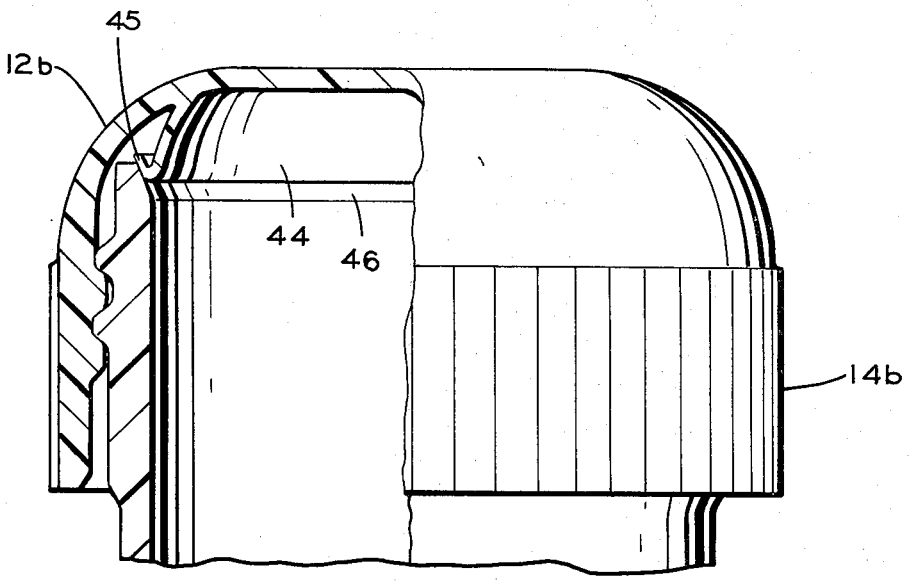
FIG. 5 is a sectional view of another embodiment of the invention, including alternative dome and plug configurations.

Another example of a dome having an alternate curved surface is shown in FIG. 5. As seen in the sectional view of FIG. 5, the arc of the dome 12*b* has a radius less than the radius of the skirt 14*b*. As the radius of the arc becomes smaller, the advantages of the invention heretofore described become minimized; therefore the choice of the arc radius must be carefully coordinated with other design parameters to effect the optimum design.

In the preferred embodiment illustrated in FIGS. 1 and 2, a plug seal is utilized. However, the relatively great rigidity of the dome configuration improves sealing with other types of sealing members also. For example, in the embodiment illustrated in FIG. 3, resilient sealing members 40 and 41 depend from the inside concave surface of the dome 12*a* to form seals against the top annular rim surface of the finish and the outside cylindrical surface of the finish respectively. This embodiment does not include vents but has the advantages of the dome configuration.

Figure 4:
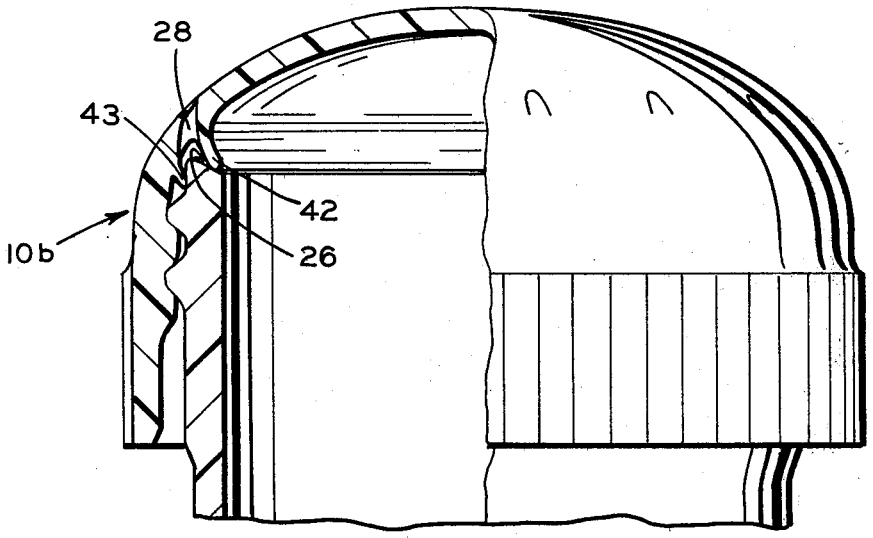
FIG. 4 is a sectional view of another embodiment of a closure according to the invention, illustrating the provision of a pilfer indicator of the invention.

In the embodiment illustrated in FIG. 4, integrally formed resilient sealing members 42 and 43 are provided which are arranged to contact and seal against the inside and outside annular edges, respectively, of the finish rim 26. Venting ports 28 are shown, similar to those shown in FIGS. 1 and 2.

The embodiment illustrated in FIG. 5 includes a depending annular plug 44 having an outwardly and upwardly bent portion 45 arranged to contact a downwardly and inwardly beveled inner surface 46 of the container finish. This embodiment does not include vents but has the advantages of the dome configuration.

All of the embodiments illustrated and described include a sealing member integrally connected to a dome portion, having its base or root on an inside, convex surface of the dome. The dome provides a superior pressure containing vessel with greater resistance to bulging than conventional closures having only flat panels. Hence, the sealing members are less likely to be distorted due to internal container pressures, and seal performance is enhanced. Furthermore, because the sealing members depend from an upwardly and inwardly concave surface curving above the container rim, they may be made axially longer than if depending from a flat panel abutting the container rim.

Although specific embodiments of the invention have been described in detail, variations may be made without departing from the spirit of the invention. It is intended, therefore, that the scope of the invention be determined solely by the appended claims.

What is claimed is:

1. A thermoplastic closure for a container, said container having a threaded finish terminating in an annular rim, said rim defining an opening into said container and having an upper rim portion, a lower rim portion and a top rim portion, said closure comprising:

an annular internally threaded skirt portion operative to engage said container threads;

a unitary top portion extending upwardly from said annular skirt portion and closing the top of the closure;

a first and second sealing means depending from said top portion, said first sealing means including an annular sealing member depending downwardly from said top portion and operative to engage the upper rim portion on the inside surface of said finish and said second sealing means including an annular sealing member depending downwardly from said top portion and operative to engage the lower rim portion on the outside surface of said finish; and at least one vent port disposed on said top portion radially between said first and second sealing means.

2. The invention defined in claim 1 wherein said vent ports are sealed by a frangible membrane of plastic such that when subjected to an internal pressure of said container said membranes rupture.

3. The invention defined in claim 1 wherein said vent ports are angled upwardly and inwardly from the inside of the closure unitary top portion towards a single focal point spaced from said unitary top portion.

4. A thermoplastic closure for a container, said container having a threaded finish terminating in an annular rim, said rim defining an opening into said container and having an upper rim portion, a lower rim portion and a top rim portion, said closure comprising:

an annular internally threaded skirt portion operative to engage said container threads;

a unitary top portion extending upwardly from said annular skirt portion and closing the top of the closure;

a first and second sealing means depending from said top portion, said first sealing means including an annular sealing member depending downwardly from said top portion and operative to engage the top rim portion of said finish and said second sealing means including an annular sealing member depending downwardly from said top portion and operative to engage the lower rim portion on the outside surface of said finish; and at least one vent port disposed on said top portion radially between said first and second sealing means.

5. The invention defined in claim 4 wherein said vent ports are sealed by a frangible membrane of plastic such that when subjected to an internal pressure of said container said membranes rupture.

6. The invention defined in claim 4 wherein said vent ports are angled upwardly and inwardly from the inside of the closure unitary top portion towards a single focal point spaced from said unitary top portion.

* * * * *